US007266956B2

(12) United States Patent
Norrell et al.

(10) Patent No.: US 7,266,956 B2
(45) Date of Patent: Sep. 11, 2007

(54) BASE PAN AND CABINET FOR AN AIR CONDITIONER

(75) Inventors: Billy W. Norrell, Panama City Beach, FL (US); Danny D. Beaver, Tyler, TX (US)

(73) Assignee: American Standard International Inc., New York, NY (US)

( * ) Notice: Subject to any disclaimer, the term of this patent is extended or adjusted under 35 U.S.C. 154(b) by 35 days.

(21) Appl. No.: 11/133,422

(22) Filed: May 19, 2005

(65) Prior Publication Data

US 2005/0204767 A1 Sep. 22, 2005

Related U.S. Application Data

(62) Division of application No. 10/156,560, filed on May 24, 2002, now Pat. No. 6,705,105, and a division of application No. 10/719,437, filed on Nov. 21, 2003, now Pat. No. 6,912,766.

(51) Int. Cl.
*F25B 49/02* (2006.01)

(52) U.S. Cl. ..... 62/125; 62/298

(58) Field of Classification Search ..... 62/298, 62/508

See application file for complete search history.

(56) References Cited

U.S. PATENT DOCUMENTS 4,153,310 A 5/1979 Loving et al.
4,261,418 A * 4/1981 Helt et al. ..... 165/134.1
4,471,633 A 9/1984 Tinsler
4,723,419 A 2/1988 Kessler et al.
4,748,827 A 6/1988 Chang
4,748,828 A 6/1988 Chang
5,294,195 A 3/1994 Amr et al.
5,306,121 A 4/1994 Heflin et al.
5,831,531 A * 11/1998 Tuttle ..... 340/568.2
5,909,176 A * 6/1999 Schrott et al. ..... 340/572.1
6,068,048 A 5/2000 Cude
6,107,920 A * 8/2000 Eberhardt et al. ..... 340/572.7
6,168,248 B1 1/2001 Timmons et al.
6,456,039 B1 * 9/2002 Lauper et al. ..... 320/107
6,480,100 B1 * 11/2002 Frieden et al. ..... 340/10.1
6,705,106 B1 * 3/2004 Cunha et al. ..... 62/342
6,816,083 B2 * 11/2004 Brandt ..... 340/870.11

* cited by examiner

*Primary Examiner*—William E. Tapolcai
(74) *Attorney, Agent, or Firm*—William J. Beres; William O'Driscoll

(57) ABSTRACT

An air conditioner includes an outdoor section comprising an outdoor coil, a fan, and a refrigerant compressor housed within a cabinet. The cabinet includes an outer wrapper supported by a plastic base. The base and wrapper include features that facilitate the cabinet's assembly and shipping, enhance its appearance, and ensure its functional and structural integrity. For example, the base includes breakaway shipping tabs, lead-ins that help guide the wrapper and coil into position during assembly, and snaps that help hold the wrapper in place with a minimal number of screws. The wrapper includes watertight screw-receiving dimples for mounting electrical hardware, side panels that interconnect by way of a novel vertically sliding fit, and a spacer for protecting the coil from being crushed by the wrapper. A frame that supports the fan also supports the cabinet's top cover.

8 Claims, 8 Drawing Sheets

FIG. 5
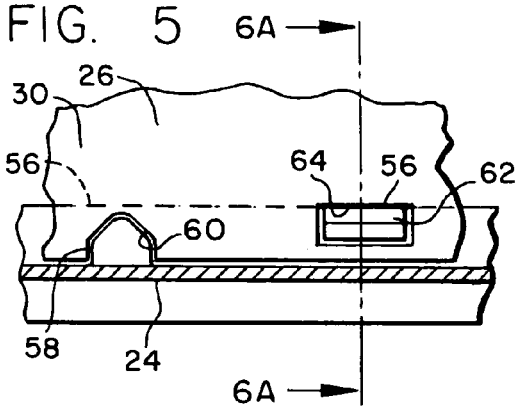
FIG. 6A
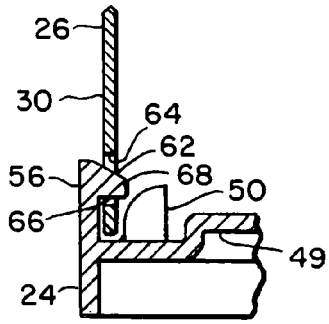
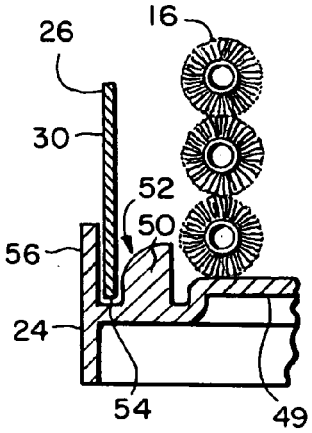
FIG. 4
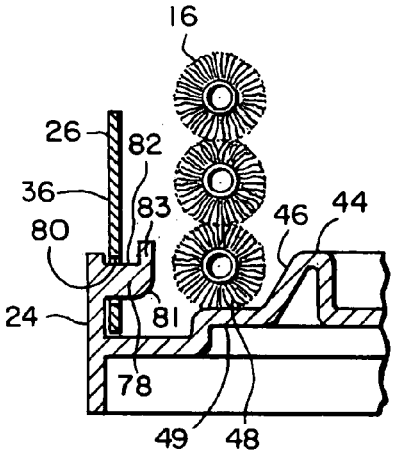
FIG. 3
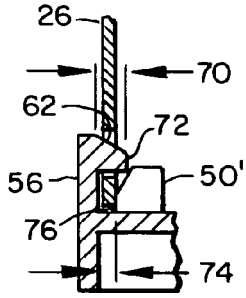
FIG. 6B
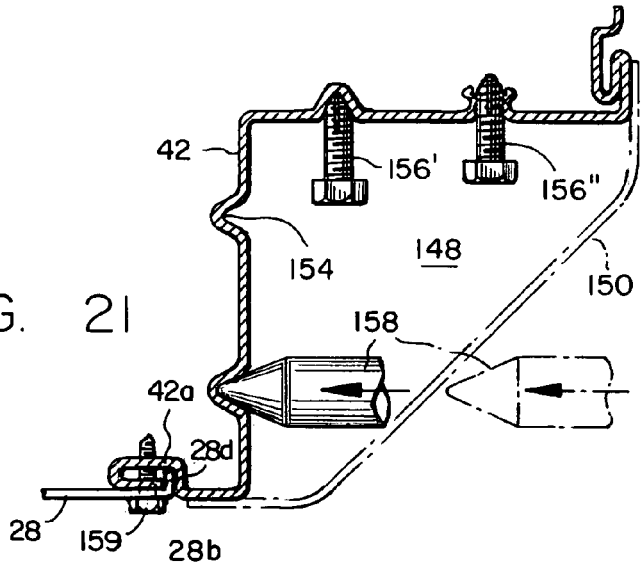
FIG. 21

FIG. 11
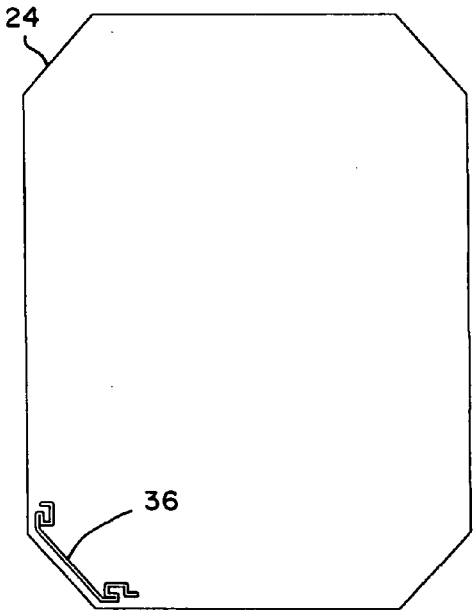
FIG. 12
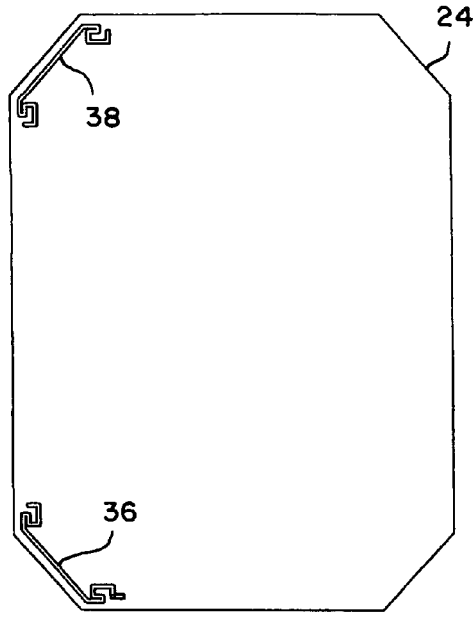
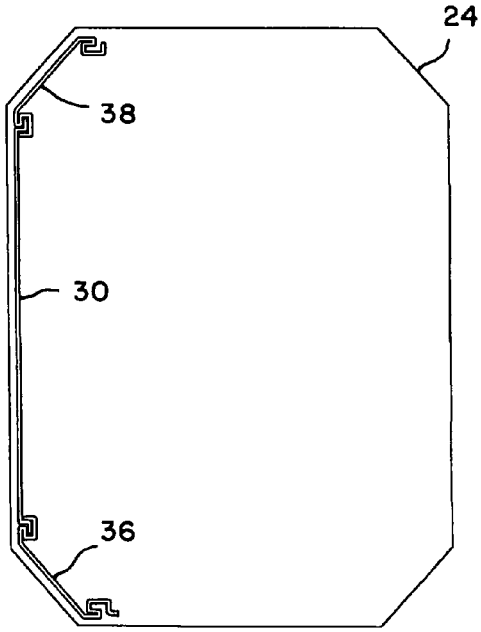
FIG. 13
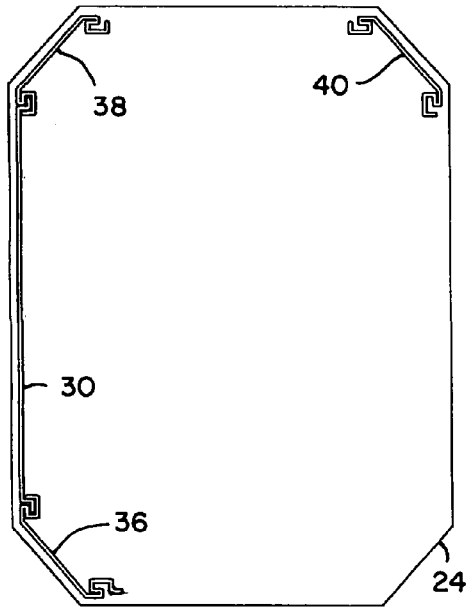
FIG. 14

FIG. 15
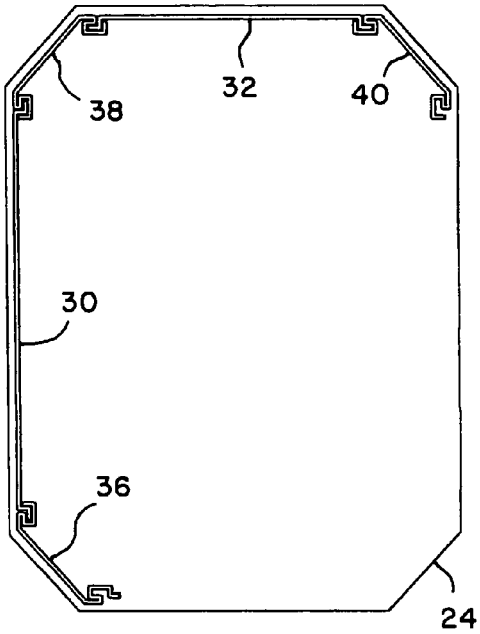
FIG. 16
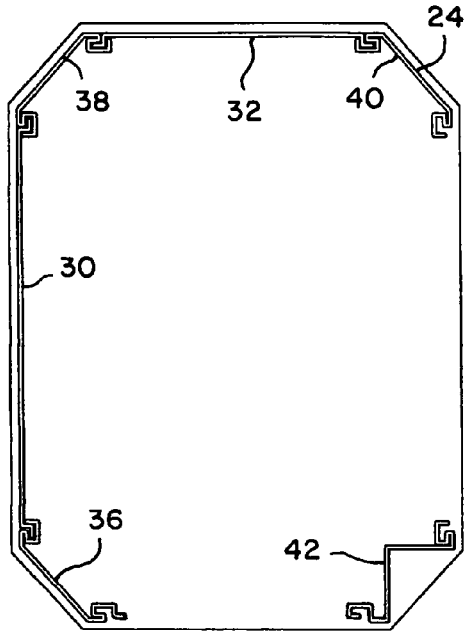
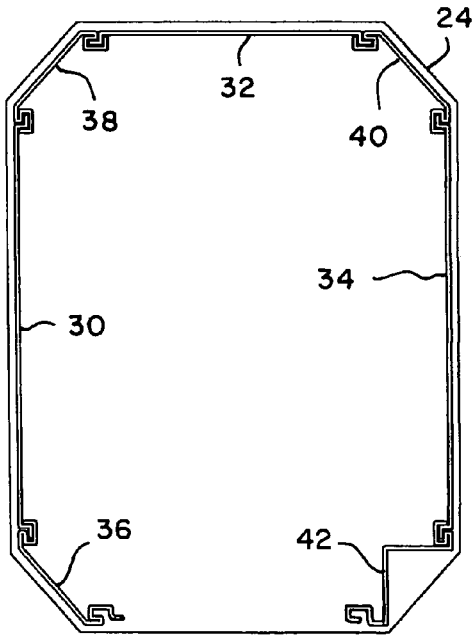
FIG. 17
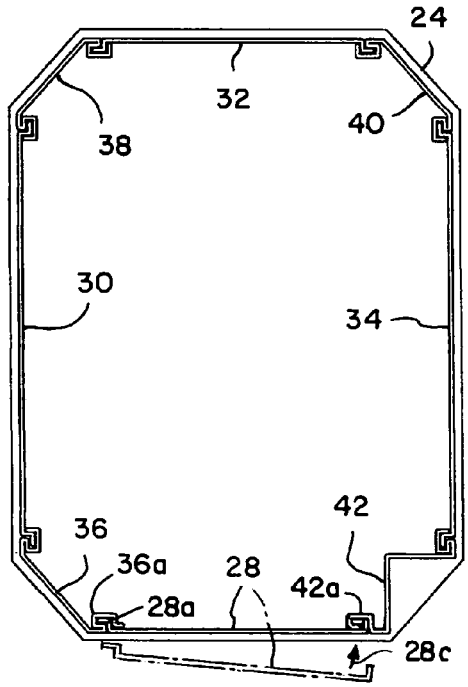
FIG. 18

BASE PAN AND CABINET FOR AN AIR CONDITIONER

This is a divisional application of U.S. patent application Ser. No. 10/156,560, filed May 24, 2002, which issued as U.S. Pat. No. 6,705,105, and a first divisional U.S. patent application Ser. No. 10/719,437, filed Nov. 21, 2003 now U.S. Pat. No. 6,912,766.

BACKGROUND OF THE INVENTION

1. Field of the Invention

The present invention pertains to a cabinet for an outdoor section of an air conditioner, and more specifically to a cabinet with features that facilitate its manufacturing and assembly.

2. Description of Related Art

Air conditioners, including heat pumps, often include an indoor section with an indoor heat exchanger for cooling or heating the interior of a building and an outdoor section with an outdoor heat exchanger for exchanging heat with the outside air. The two heat exchangers are part of closed loop refrigerant circuit that also includes a compressor and an expansion device, which compress and expand the refrigerant respectively. As the refrigerant moves through the circuit, its direction of flow determines whether the indoor heat exchanger cools or heats the air inside the building.

A typical outdoor section of an air conditioner includes a cabinet that supports and shelters numerous components, such as the compressor, various electrical components, the outdoor heat exchanger, and a fan for drawing outside air through the heat exchanger. The compressor relies on the base of the cabinet for structural support; the electrical components need to be sheltered from rain and snow; and the fan and heat exchanger need structural support, exposure to outside air, and protection from the weather and physical impact. Moreover, the cabinet should be readily manufacturable and provide convenient access to any components requiring service or repair. Providing a cabinet that effectively serves all these needs without compromise can be challenging. Nonetheless, many efforts to provide such a cabinet have been made with some success.

For example, U.S. Pat. No. 5,294,195 discloses an outdoor cabinet that houses electrical components at the top of the cabinet. A small cover can be opened or removed for providing ready access to the electrical components underneath. However, the edges of the cover, being exposed along the top of the cabinet, create a generally unsheltered seam that may leak or may be difficult to seal against rain and snow.

Another cabinet for an outdoor section of an air conditioner places its electrical components in a compartment underneath the cabinet's top cover, as disclosed in U.S. Pat. No. 4,153,310. To accommodate various models of air conditioners, the compartment has numerous fastener and passage openings for installing various combinations of components. However, having some openings left open for some models may allow moisture to leak into the compartment from other areas of the cabinet that may be more exposed to outside air.

Some cabinets include features that enhance various functions of the cabinet's base. For example, U.S. Pat. No. 4,471,633 discloses a non-corrosive plastic base with integrally formed mounting pads that can support various size compressors and other components. It also includes means for handling condensate. Other cabinet bases that include special features for draining condensate are disclosed in U.S. Pat. Nos. 4,748,827 and 4,748,828. In U.S. Pat. No. 5,306,121, a cabinet base is shown having a novel means for mounting the compressor. An intermediate plate between the compressor and the base includes elastic isolators both above and below the plate to avoid transmitting compressor vibration to the base.

Another outdoor cabinet, disclosed in U.S. Pat. No. 6,168,248, discloses a plastic base with positioning cleats that help align the side panels, or sheet metal wrapper, to the base. Once in position, a series of screws fasten the side panels to the side of the base. Each of the outer side panels has an L-shape to extend the length of two sides of the base. L-shape panels may simplify assembly; however, later servicing may be more difficult, as technicians may have to fully uncover two sides of the outdoor cabinet even in situations where access to only side is needed. Moreover, many of screws for fastening the wrapper to the base are along the lower edge of the cabinet. Such a location may be awkward to reach once the cabinet is installed outside at generally ground level.

SUMMARY OF THE INVENTION

To facilitate the assembly and later servicing of an air conditioner's outdoor section, it is an object of the invention to provide a cabinet that can be assembled with a minimal number of fasteners.

Another object is to provide a cabinet whose base includes snap-in elements that help hold the cabinet's wrapper to the base.

Another object is to provide a base with a raised peripheral rim that helps hold the cabinet's wrapper in position.

Yet, another object is to provide the base with wrapper lead-ins that help properly position the wrapper against the raised peripheral rim.

A further object is to provide a cabinet's base with upwardly protruding lead-ins that help guide a heat exchanger coil into position as the coil is being lowered onto the base.

A still further object is to provide a cabinet wrapper with side panels that interlock by way of a sliding connection between adjacent panel members.

A still further object is to provide side or corner panels with a series of dimples that enhance the holding power of the sliding connection between adjoining panel members.

Another object is to provide an assembly sequence for the cabinet such that each panel member helps hold its adjacent panel members in place, yet the panel members can be installed and removed individually.

Another object is to provide certain panel members of a cabinet with screw-receiving dimples at various locations. Each dimple can serve as a pilot hole for inserting a screw for mounting various electrical components. The dimples are watertight, so if any are left unused, they can inhibit water from entering the area where the electrical components are installed.

Another object of the invention is to provide an air conditioner cabinet with a spacer that helps hold the cabinet's wrapper spaced apart from a heat exchanger coil contained inside the cabinet.

Yet another object is to provide such a spacer with an anchor that allows the spacer to hold itself to the coil of a heat exchanger. The anchor may allow infinite repositioning of the spacer.

Another object is to provide an air conditioning cabinet with a fan frame that not only supports the frame, but also helps support the cabinet's top cover.

Another object is to provide the base of an air conditioner cabinet with breakaway shipping tabs. When shipping the unit, the tabs help hold the cabinet to a shipping pallet. Later, the tabs can be severed to readily remove the cabinet from the pallet.

These and other objects of the invention are provided by an outdoor section of an air conditioner that includes a wrapper mounted to a plastic base. To facilitate the assembly or servicing of the air conditioner, the base may include one or more features such as wrapper or coil lead-ins, a raised peripheral rim to hold the wrapper, snaps rather than screws to anchor the wrapper to the base, and breakaway shipping tabs. The wrapper may also include one or more features such as interconnecting sliding seams; watertight dimples for receiving screws; or a sequence of assembly that allows the wrapper's panels to support each other, yet allows the panels to be installed and removed individually.

BRIEF DESCRIPTION OF THE DRAWINGS

FIG. 3 is a cross-sectional view taken along line 3-3 of FIG. 2.

FIG. 4 is a cross-sectional view taken along line 4-4 of FIG. 2.

FIG. 5 is a cross-sectional view taken along line 5-5 of FIG. 2.

FIG. 6A is a cross-sectional view taken along 6A-6A of FIG. 5.

FIG. 6B is similar to FIG. 6A but of an other embodiment.

FIGS. 11-18 show one possible assembly sequence of the wrapper as viewed from the top.

FIG. 21 is a cross-sectional top view showing how a watertight dimple is formed and how a screw is subsequently installed through it.

DESCRIPTION OF THE PREFERRED EMBODIMENT

Figure 1:
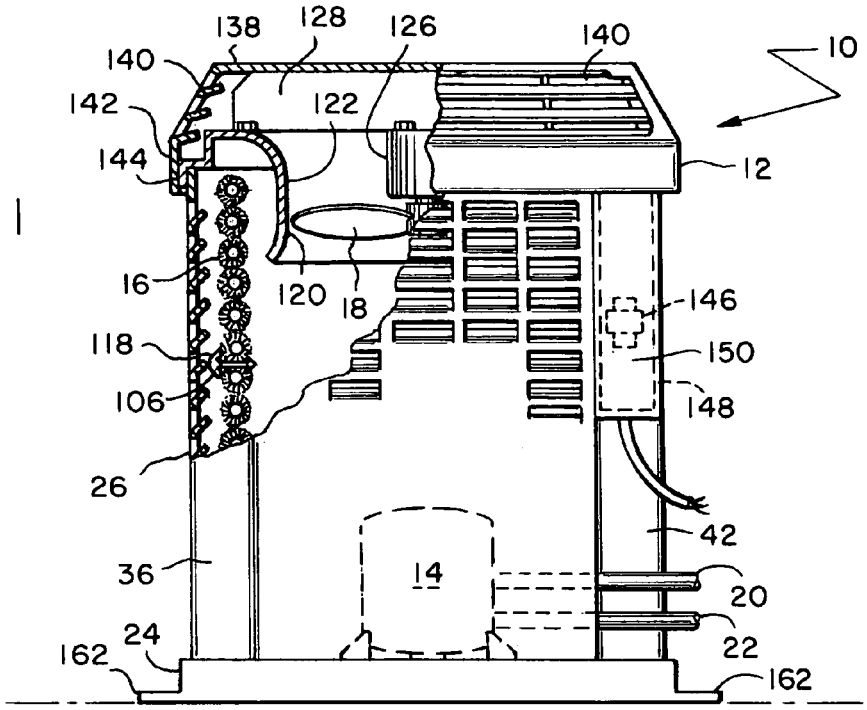
FIG. 1 is a cutaway front view of an outdoor section of an air conditioner according to one embodiment of the invention.

FIG. 1 is a cutaway view showing the basic components of an outdoor section 10 of an air conditioner. The term, "air conditioner" refers to any apparatus (including, but not limited to heat pumps) for cooling and/or heating a comfort zone, such as a room or area within a building. In this case, outdoor section 10 includes a cabinet 12 containing a refrigerant compressor 14, an outdoor heat exchanger coil 16, and a fan 18. Through lines 20 and 22, a conventional closed loop refrigerant circuit connects compressor 14 and outdoor coil 16 to the air conditioner's indoor section, not shown, which may include an indoor heat exchanger coil associated with a blower for delivering cooled or heated air to the comfort zone. Whether the indoor coil is used for heating or cooling depends on the configuration of the particular refrigerant circuit, and more specifically, the sequence through which the refrigerant flows through the indoor coil, outdoor coil 16, compressor 14, and an expansion device (e.g., an expansion valve, capillary tube, or similar flow restrictor).

Figure 2:
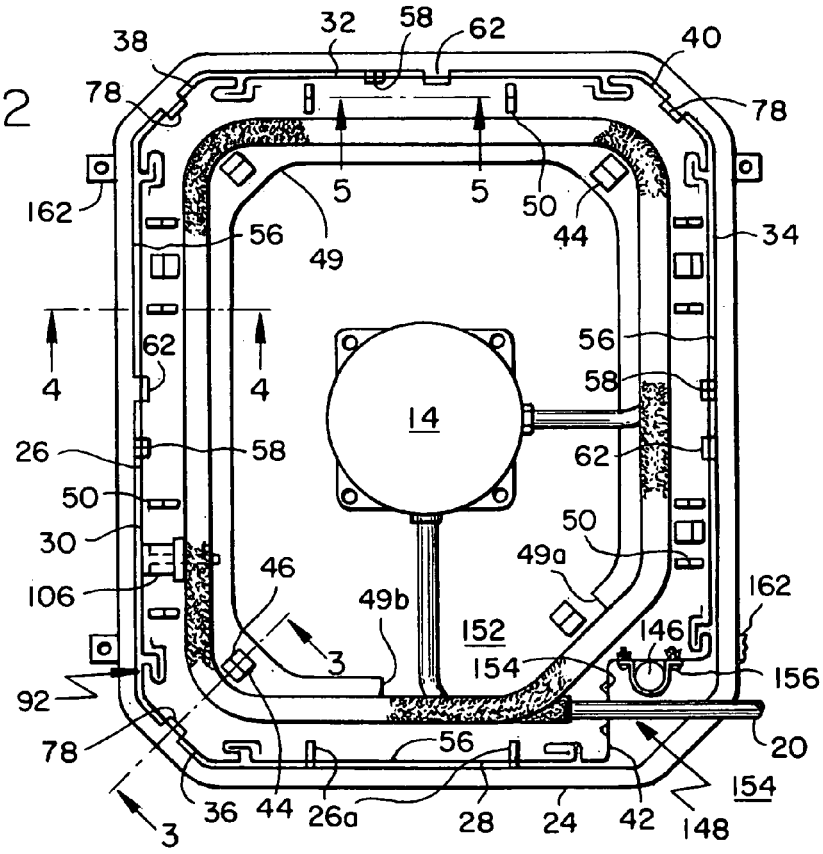
FIG. 2 is a top view of the outdoor section of FIG. 1, but with an upper portion and one shipping tab removed.

The primary focus of the invention pertains to cabinet 12 of outdoor section 10. Referring to FIGS. 1 and 2, cabinet 12 includes a base 24 and a wrapper 26. Base 24 is preferably fabricated from an engineered material such as polypropylene, ABS or polycarbonate. Wrapper 26 comprises several interconnected sheet metal panels, such as side panels 28, 30, 32 and 34 and corner panels 36, 38, 40 and 42. Wrapper 26 and base 24 include numerous features that facilitate the cabinet's assembly, enhance its appearance, and ensure its structural and functional integrity.

For example, referring to FIGS. 1-3, base 24 includes several coil lead-ins 44 that each has an inclined surface 46 for guiding a lower surface 48 of coil 16 into its proper position on coil ramp 49 of base 24 during assembly. Lead-ins 44 extend integrally from base 24, such that base 24 and lead-ins 44 comprise a unitary piece for ease of manufacturing.

Referring further to FIG. 4, coil 16 is preferably a helically wound coil. Lower surface 48 of coil 16 sits on a helical coil ramp 49 that rises off of base 24 and is preferably integral therewith. In that regard, first end 49*a* of coil ramp 49 is essentially flush with the surface of base 24 and helically increases in height in a direction toward end 49*b* of the coil ramp. The helical ramping of coil ramp 49 accommodates the helical wind of coil 16 with the result that coil 16 is stable and sits vertically on base 24.

Base 24 also includes several wrapper lead-ins 50 that each has an curved surface 52 for guiding a lower edge 54 of wrapper 26 into its proper position on base 24 and up against or at least adjacent to a raised peripheral rim 56. Wrapper lead-ins 50 are also integrally formed with base 24 to comprise a unitary piece.

Several alignment tabs 58 provide further alignment of wrapper 26 to base 24, as shown in FIGS. 2 and 5. Each alignment tab 58 extends integrally from base 24 and is adapted to engage a slot 60 in a side panel of wrapper 26. Thus, lead-ins 50, alignment tabs 58, and rim 56 all help to ensure that the side panels and the totality of wrapper 26 are installed in their proper position and relationship relative to base 24.

To reduce the use of conventional threaded fasteners, a number of catches 62 integrally extending from peripheral rim 56 of base 24 help secure wrapper 26 in place, as shown in FIGS. 2, 5 and 6A. Each catch 62 protrudes into a hole 64 of a side plate of wrapper 26. A lower edge 66 of catch 62 engages the lower edge of hole 64, which limits the extent to which wrapper 26 can move away from base 24 once the wrapper is in place. Providing catch 62 with a tapered upper edge 68 and staggering the positions of catches 62 relative to lead-ins 50 (i.e., the catches and lead-ins are not directly across from each other) allows wrapper 26 to flex and snap into place by lowering wrapper 26 between catch 62 and lead-ins 50 during assembly.

This snap-in feature is further illustrated in the embodiment of FIG. 6B, wherein a lead-in 50' replaces lead-in 50 and is positioned closer to rim 56 to ensure more positive engagement between catch 62 and wrapper 26. Staggering the positions of catches 62 and lead-ins 50' allows the positioning of the catches and lead-ins such that a greater spacing 70 exists between peripheral rim 56 and a distal edge 72 of catch 50' than a spacing 74 between rim 56 and a shoulder 76 of lead-in 50'. Yet, the wrapper's flexibility still allows wrapper 26 to snap into position.

To hold corner panels 36, 38 and 40 in place, another catch 78 extending from rim 24 protrudes through a hole 80 in those corner panels, as shown in FIGS. 2 and 3. Side panel 28 and corner panel 42 are each somewhat unique as will further be described below.

In a currently preferred embodiment, catch 78 protrudes much farther from rim 24 than does catch 62 and includes an upper surface that has a vertically extending lip 83. At assembly, the hole 80 of each of these corner panels is engaged over a corresponding catch 78 and is rotated to the vertical position illustrated in FIG. 3. Once the remainder of wrapper 26 is assembled, the substantial protrusion of catches 78 provides a very positive, solid connection between base 24 and the corner panels. However, in the rare event that it becomes necessary to remove a side panel to corner piece after assembly, such removal can be accomplished by the simple expedient of disengaging the catches 62 and/or 78 from the hole in the wrapper or corner panel in which they reside.

Figure 7:
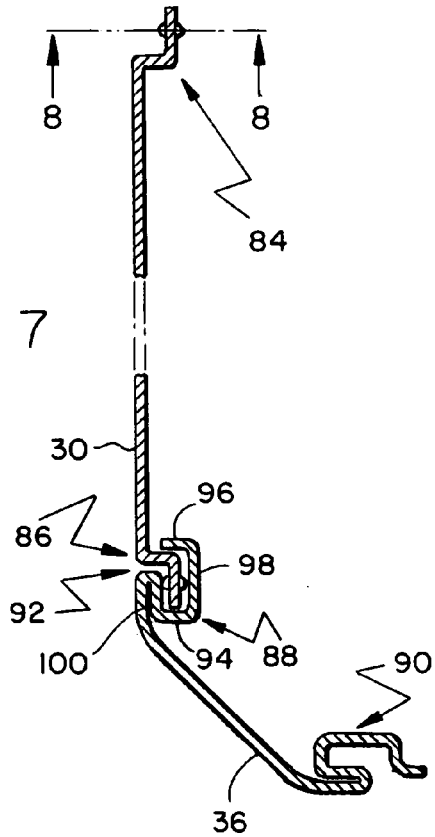
FIG. 7 is a top view of a side panel and a corner panel.

To hold the sides of wrapper 26 together with a minimal number of screws (if any), the wrapper's various side and corner panels are interconnected by vertically sliding fits between mating edges of adjacent panels. Referring to FIGS. 2 and 7, for example, the vertical edges of side panel 30, like those of side panels 32 and 34, are roll formed (or otherwise formed) to create two generally L-shaped edges 84 and 86. One or more corner panels also have their vertical edges roll formed (or otherwise formed) to create edges adapted to receive the L-shaped edges of an adjoining wrapper panel. Corner panel 36, for example, includes edges 88 and 90. Mating edge 88 of corner panel 36 engages edge 86 of side panel 30 to create a vertically sliding fit 92, referred to as a slip seam, between the two.

To inhibit side panel 30 from horizontally separating from corner panel 36, edge 88 is formed to wrap at least partially around and capture the L-shaped edge 86 of side panel 30, as is the case with side panels 32 and 34 and their interaction with the corner panels between which they reside. More specifically, edge 88 includes a first segment 94 and a second segment 96 that restrains and limits the movement of edge 86 of side panel 30 in a first horizontal direction. Further, edge 88 includes a third segment 98 and a fourth segment 100 that restrains and limits the movement of edge 86 of side panel 30 in a second horizontal direction generally perpendicular to the first direction.

Figure 8:
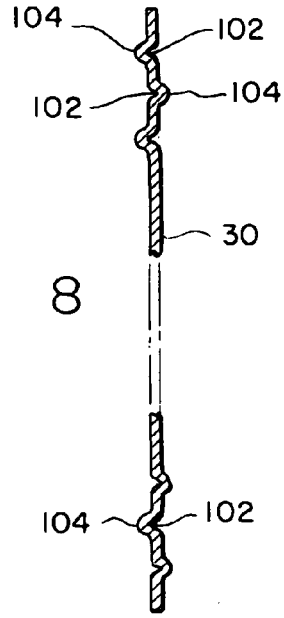
FIG. 8 is a cross-sectional view taken along line 8-8 of FIG. 7.
Figure 9:
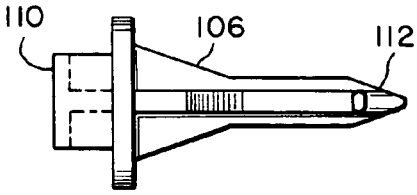
FIG. 9 is a top view of a wrapper/coil spacer.
Figure 10:
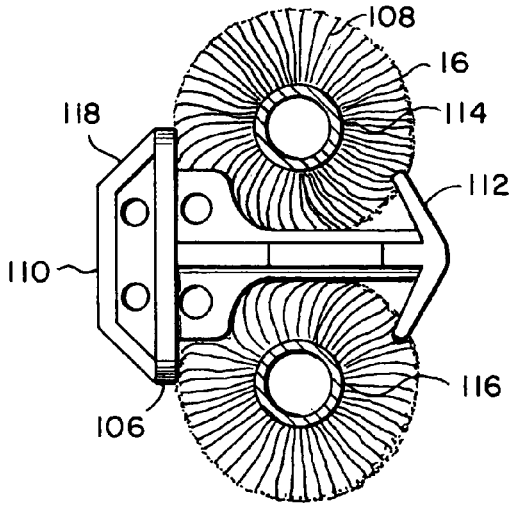
FIG. 10 is a front view of the spacer of FIG. 9.

Referring to FIGS. 7 and 8, forming a series of dimples 102 along vertical edge 84 or 86 of a side panel such as side panel 30 creates a corresponding series of protrusions 104 that enhance the vertical grip between the side panels and corner panels of wrapper 26. Protrusions 104 are spaced apart and face in opposite directions, so that as edge 86 is slid vertically downward within the confines of edge 88 of a corner panel, the inner surfaces of edge 88 engage dimples 104 and then urge into a more coplanar orientation, which causes resilient localized bending in the sheet metal of edge 86. The resilience of the sheet metal acting upon protrusions 104 maintains horizontal pressure between protrusions 104 and the inner surfaces of edge 88. The horizontal pressure creates a frictional force that tightens the sliding fit between edges 86 and 88 and results in a strong and rigid unit wrapper 26.

In assembling outdoor section 10, compressor 14 and coil 16 are generally the first main components to be installed on base 24. In some cases, one or more plastic spacers 106, such as the one shown in FIGS. 1, 2, 9 and 10 can be attached to coil 16 to ensure adequate space for airflow between coil 16 and the adjacent wrapper 26 and, when outdoor section 10 is part of a heat pump system, to inhibit frost/ice bridging between the wrapper and coil. Also, if coil 16 includes spine fins 108, ensuring such space between coil 16 and wrapper 26 may help prevent wrapper 26 from crushing the fins either during or after assembling the unit.

In a currently preferred embodiment, spacer 106 comprises a unitary plastic injection molded piece having a head 110 and an anchor 112 at opposite ends. Head 110 is adapted to abut an inner face of a side panel, and anchor 112 engages coil 16. In some embodiments, spacer 106 attaches to coil 16 by forcing anchor 112 between the spine fins 108 of two adjacent coil wraps or tube sections 114 and 116 of coil 16. Anchor 112 firmly engages the spine fins 108 of tube sections 114 and 116 and thereby holds spacer 106 in place. Head 110 preferably includes a tapered surface 118 that can help redirect a lower edge of a side panel away from coil 16 as the panel is being lowered into position during assembly.

Assembling the side and corner panels to base 24 preferably follows the suggested steps illustrated sequentially in FIGS. 11-19. In FIG. 11, corner panel 36 is installed with hole 80 being slipped around catch 78 in a manner previously explained with reference to FIGS. 2 and 3. In a similar manner, corner panel 38 is installed next, as shown in FIG. 12. Next, side panel 30 is vertically slid downward into position between corner panels 36 and 38, as shown in FIG. 13, having been piloted into final position on base 24 by lead-ins 50 and alignment tabs 58 as earlier described. At this point in the assembly process, side panel 30 and corner panels 36 and 38 are generally well supported. The vertical edges of side panel 30 are fully engaged in the mating edges of corner panels 36 and 38, catch 62 has side panel 30 snapped into position between rim 56 and lead-in 50, and the lower ends of corner panels 36 and 38 engage their respective catches 78.

Assembly may continue by installing corner panel 40, as shown in FIG. 14, and then sliding side panel 32 between corner panels 38 and 40, as shown in FIG. 15. Next, in FIG. 16, corner panel 42 is installed on the base. Because of its unique geometry and function, corner panel 42 latches into base 24 in a manner different from the other corner panels and has a unique seam 42*a* that is best illustrated in FIG. 21 which is discussed below.

Figure 19:
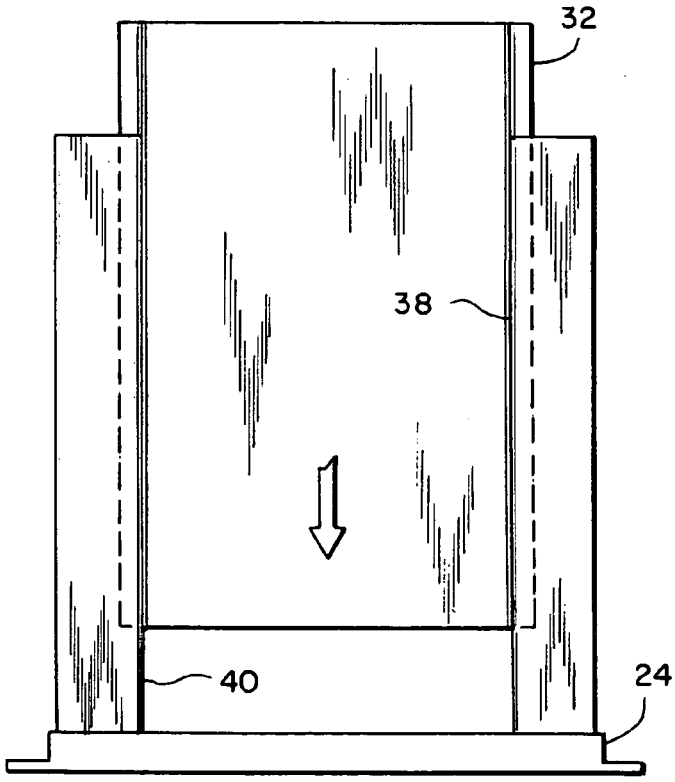
FIG. 19 is a front view of a side panel being slid downward into position between two corner panels.

Next, side panel 34 is slid into position between corner panels 40 and 42, as illustrated in FIG. 17, and side panel 28 is engaged between corner panels 36 and 42, as shown in FIG. 18 and as will subsequently be described. FIG. 19 shows a front view of how a side panel (e.g., side panel 32) is slid into position between two supporting corner panels (e.g., corner panels 38 and 40).

Figure 20:
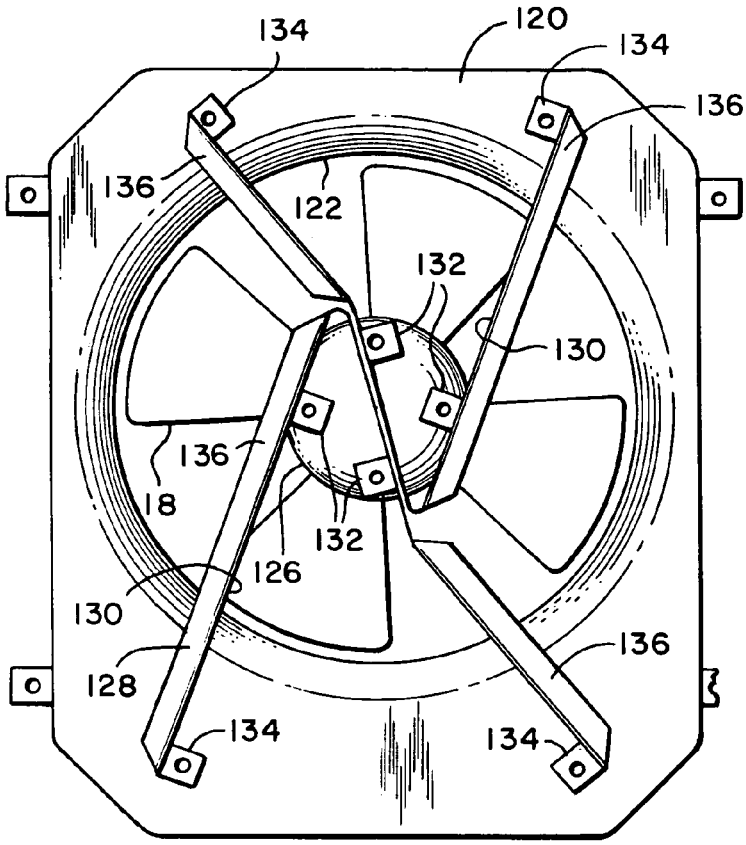
FIG. 20 is a top view of a fan, fan frame, and a fan orifice member.

Once base 24 and wrapper 26 are assembled to the extent shown in FIGS. 2 and 18, an orifice member 120 can be installed on top of wrapper 26, as shown in FIGS. 1 and 20. Orifice member 120 defines a fan orifice 122. In operation, fan 18 draws outside air through louvers 124 in the side panels of wrapper 26 and across coil 16 so as to exchange heat with the refrigerant inside the coil.

Fan 18 is driven by a motor 126 that is supported by a frame 128 attached to orifice member 120. Frame 128 comprises two substantially identical sheet metal frame members 130 that can be attached to each other in a conventional manner, such as by way of screws, welding, etc. Together, frame members 130 provide four tabs 132 that are screwed or otherwise attached to motor 126 to support and position motor 126 within orifice member 120 and four other tabs 134 that attach to orifice member 120 so as to secure frame 128 thereto. Each frame member 130 includes two flange surfaces 134 and 136 for stiffness and for providing a surface area upon which a top cover 138 rests and finds support.

Top cover 138 rests atop frame 128 and provides a protective shield over fan 18. As fan 18 draws outside air into cabinet 12 and across coil 16, openings 140 around the perimeter of cover 138 allow fan 18 to discharge the air back to the ambient, generally in a direction which is upward and away from the cabinet sides. A lower rim 142 of cover 138 attaches to wrapper 26 by way of screws or some other appropriate means for attachment. In some cases, an outer rim 144 of orifice member 120 lies between cover rim 142 and the upper edge of wrapper 26, so top cover 138 engages orifice member 120.

Since outside air is drawn into cabinet 12, moisture can be drawn in as well. To prevent that moisture from contaminating electrical components 146 associated with air conditioner 10, components 146 are housed inside a compartment 148 adjacent corner panel 42 and underneath top cover 138, as shown in FIGS. 1, 2 and 21. Components 146 are schematically illustrated to represent any type of electrical component including, but not limited to, relays, motor starters, motor starting capacitor, wires, control circuits, electrical terminals, etc. Corner panel 42 shelters the electrical components 146 from moisture that may be inside cabinet 12, while an outer access panel 150 fastened to corner panel 42 provides shelter from air outside of cabinet 12. Thus, in this example, corner panel 42 serves as an "interior panel," whereby panel 42 is exposed to an interior 152 of cabinet 12 and is at least partially sheltered from an exterior 154 of cabinet 12 (see FIG. 2).

Referring to FIGS. 2 and 21, components 146 can be mounted inside compartment 148 by various means. For example, components 16 may be readily attached using a screw 156 or some other type of fastener (e.g., a self-tapping screw, sheet metal screw, rivet etc.). In a currently preferred embodiment, corner panel 42 is provided with closed screw-receiving dimples 154 at numerous preplanned locations to accommodate various component-mounting arrangements for various air conditioner models. Depending on the model of a particular unit, some dimples 154 may receive a screw 156 and others may be left unused. If left unused, dimple 154 remains watertight to help prevent moisture inside cabinet 12 from leaking into compartment 148.

Dimples 154 are created by a conventional forming tool 158, as shown in FIG. 21. Dimples 154 are sufficiently deep and narrow, so that as screw 156 is turned into dimple 154, the threads of the screw bite into and grip the inner walls of the dimple, as indicated by screw 156'. Further tightening of the screw forces the screw to break through the bottom of the dimple, as indicated by screw 156". To hold the screw in place, a nut may be installed on the screw, or the thread marks left on the inner wall of the now open dimple may be sufficient to hold the screw.

Still referring to FIGS. 2 and 21 but additionally to FIG. 18, side panel 28 has a first vertical edge 28*a* which is configured in the same manner as the vertical edges of side panels 30, 32 and 34. The other vertical edge 28*b* of side panel 28 is configured differently and has a lip 28*c* that becomes ensconced in the vertically running opening at end 42*a* of corner panel 42 when panel 28 is assembled to the remainder of the wrapper.

Referring primarily now to FIG. 18, on assembly of side panel 28 to the remainder of the wrapper 26, vertical edge 28*a* of side panel 28 is inserted into the accommodating vertically running opening in edge 36*a* of corner panel 36. Such engagement results in the creation of what is essentially a pinless hinge. In that regard, once edge 28*a* of panel 28 is engaged within accommodating vertically running opening at the edge 36*a* of corner panel 36, panel 28 is swung inward, in the direction indicated by the arrow 28*c* in FIG. 18, until lip 28*d* of panel 28 enters the vertically running opening in end 42*a* of corner panel 42. Edge 28*b* of side panel 28 is then secured to end 42*a* of corner panel 42 using one or more fasteners, such as sheet metal screw 159.

Referring primarily now to FIG. 2, because of the unique arrangement and function of side panel 28, base 24 is somewhat modified on the side of it which supports panel 28. In that regard, the lower edge of panel 28 rests on supports 24*a* which are integral with and extend inwardly from rim 56 of base 24 at a horizontal height coincident with the height of the upper edge of rim 56. Supports 24*a* therefore support side panel 28 on base 26 while at the same time accommodating the ability of panel 28 to swing outward without interference from base 24. Panel 28 is therefore easily removed and access to the interior of wrapper 26 is thereby gained. Because supports 24*a* are employed in support of panel 28, alignment tabs 58 and catches 62 are dispensed with on this side of base 24.

Figure 22:
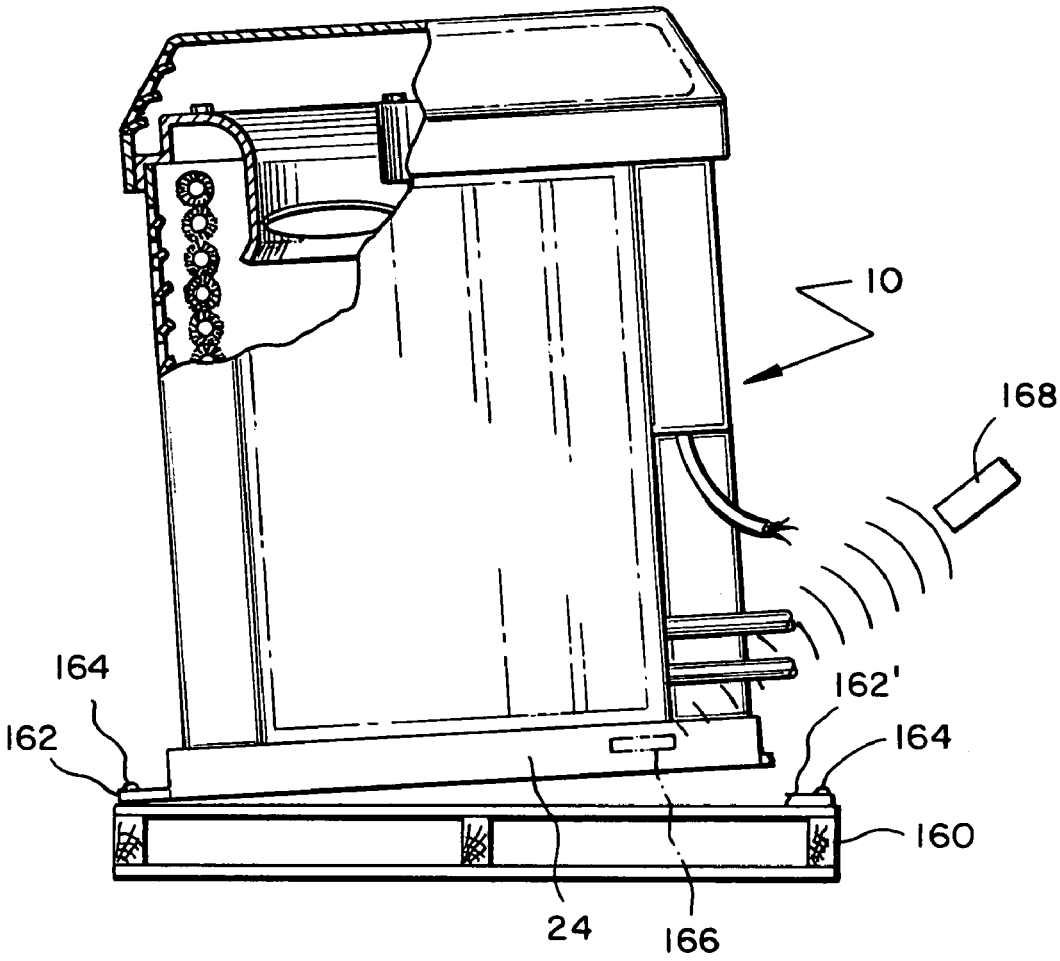
FIG. 22 is a front view of an outdoor section being removed from a shipping pallet.

Referring now to FIG. 22, temporarily mounting the outdoor section to a conventional shipping pallet 160 may help in transporting the unit before the outdoor section is permanently installed at its installation site. To that end, one or more breakaway shipping tabs 162 extend integrally from the perimeter of base 24, while a fastener 164 anchors tabs 162 to pallet 160. Fastener 164 is schematically illustrated to represent any type of conventional fastener including, but not limited to, a staple, nail, screw, etc. To remove the outdoor section from pallet 160, tabs 162 are severed by cutting, tearing, prying, or breaking, which releases base 24 and leaves a now scrap portion 162' of tab 160 still attached to pallet 160. Alternatively, the staple, nail or screw holding the unit to the pallet can itself be removed leaving the tabs intact. If so, the tabs can be used to secure the unit to the surface on which it is ultimately installed.

Also to be noted with respect to FIG. 22, it is contemplated that a radio frequency identification device may be embedded/molded into base pan 24. Device 166 is a relatively inexpensive device capable of transmitting information relating to the specific outdoor section 10 in which device 166 is embedded. Such information might include the serial number of the unit, model, information relating to the refrigerant it is charged with, date of manufacture and other such information that may be useful with regard to servicing the unit.

Because device 166 will have been molded into/embedded in base pan 24 prior to the assembly of outdoor section 10 in the factory and because outdoor sections 10 are, generally speaking, built from the base pan up, device 166 can contain additional information that is likewise readable by receiving devices positioned on the assembly line within the factory. As such, device 168 in FIG. 22 is representative of both a service device used in the field and a device that might be mounted on the assembly line in the factory where outdoor section 10 is manufactured.

Information used in the manufacturing process within a factory might include model number-related information that would be read as the base pan moves down the assembly line. Such model-related information can be used to trigger the display of information or instruction to assemblers with regard to the model being configured and the particular components/pieces that are to be used in assembling that particular model. As will be appreciated, such information might also be of value and be used in the context of warehousing, shipping and distribution of outdoor units. Overall, by the use of a relatively inexpensive and long-lived radio frequency transmitting device embedded in base pan 24, which may be self-powered and triggered in response to a query from device 168, a wealth of information is made available from the start of assembly of individual outdoor section 10 to the service of that outdoor section years later in the location in which it is installed.

Figure 23:
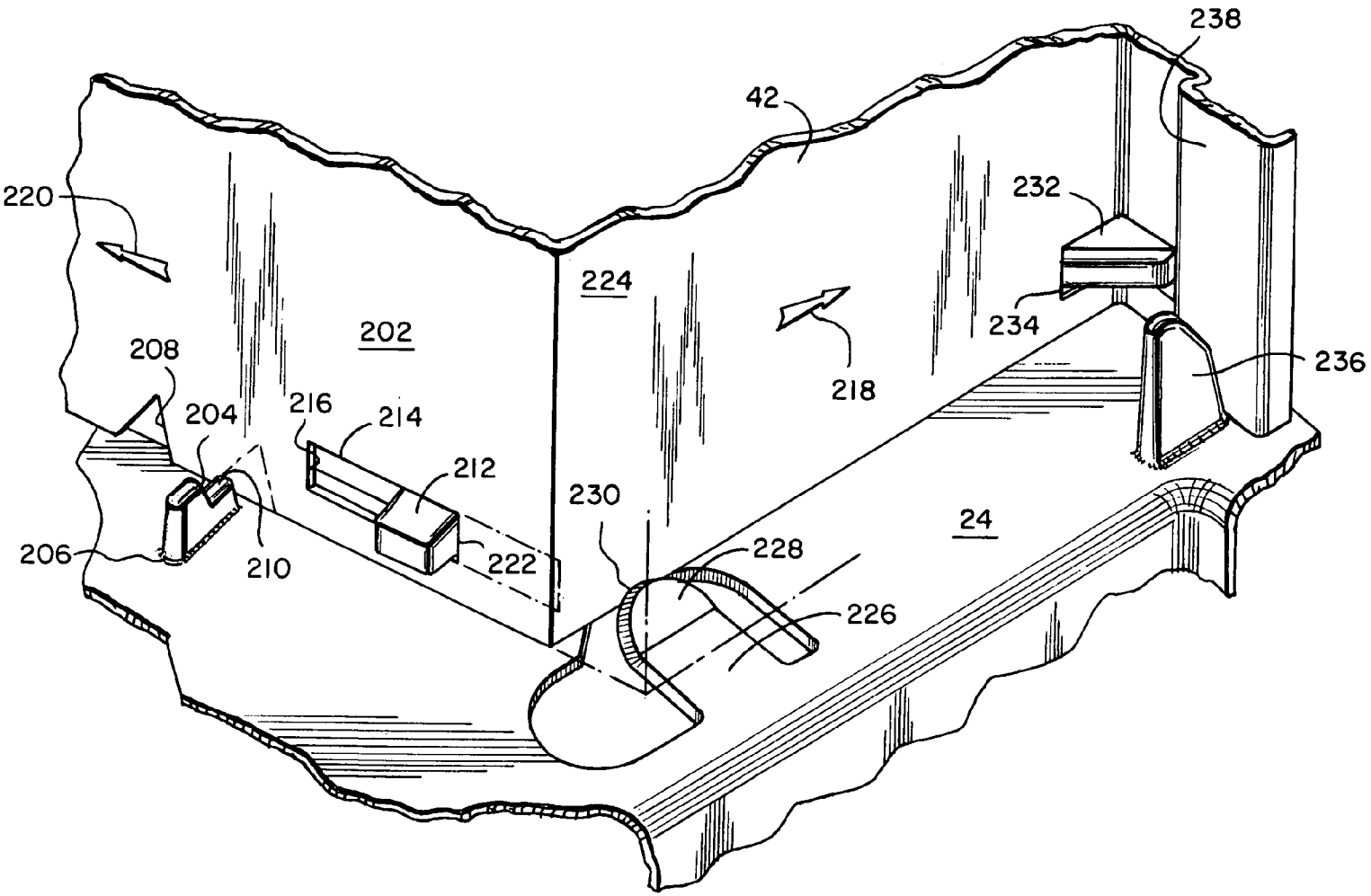
FIG. 23 is a perspective view of control box corner panel latching arrangement in the outdoor suction of the present invention.

Referring now to FIG. 23, the control box corner panel to base pan latching arrangement is illustrated. As has been noted, corner panel 42 is of a unique geometry and function in that it cooperates in the definition of the walls of compartment 148 in which control components are housed. As has also been noted, corner panel 42 latches into base 24 in a manner different from the other corner panels of cabinet 12.

In that regard, in order to latch panel 42 to base pan 24, panel 42 is aligned with the base pan such that surface 202 of panel 42 is adjacent recessed surface 204 of cleat 206 on base pan 24. In that position, notch 208 of surface 202 rests over horizontal surface 210 of cleat 206. At the time such alignment is made, post 212 of base pan 24 is generally in alignment with but does not protrude through slot 214, which is defined in surface 202 of corner panel 42, at end 216 thereof.

With corner panel 42 so aligned, panel 42 is moved horizontally away from surface 204 of cleat 206 in the direction indicated by arrow 218. As corner panel 42 is so moved, notch 208 moves off of cleat 206 and post 212 penetrates slot 214 and protrudes therethrough at end 216 thereof. This position is generally illustrated by the phantom lines in FIG. 23.

Panel 42 is then moved horizontally in the direction indicated by arrow 220, such direction being at a 90° angle to the direction indicated by arrow 218. In the process of moving panel 42 in the second horizontal direction, indicated by arrow 220, post 212 slides within slot 214 and comes into abutment with end 222 of slot 214. End 222 of the slot therefore limits the horizontal movement of corner panel 42 in the direction indicated by arrow 220.

At the same time and because the lower edge of surface 224 of corner panel 42 will have originally been positioned over surface 226 of resilient tab 228 on base pan 24, surface 224 will have depressed resilient tab 228 in the process of moving in the direction of arrow 220 and will have moved just past the end 230 of tab 228 when post 212 comes into abutment with end 222 of slot 214. Once the lower edge of surface 224 moves past end 230 of resilient tab 228, tab 228 springs upwardly to effectively and securely latch corner panel 42 in position on the base pan.

It is to be noted that one or more others of cleats 206, notches 208, slots 214 and posts 212 may exist on or in base pan 24 and corner panel 42 and be similarly arranged with respect to surface 202 of the corner panel. It is further to be noted that base pan 24 may include other cleats, posts and alignment tabs. These include post 232 which comes to protrude through slot 34 of surface 224 of corner panel 42 as the corner panel moves in the direction of arrow 220. Cleat 236 similarly positions, abuts and secures surface 238 control panel 42 into position on base pan 24 both in the initial assembly process and once corner panel 42 is latched into place.

Although the invention is described with reference to a preferred embodiment, it will be appreciated by those skilled in the art that other variations are well within the scope of the invention. For example, vertically sliding fits, such as fit 92, can be applied to any number of adjoining wrapper panels. In some embodiments of the invention, all the wrapper panels are joined in this manner, as shown in FIG. 2. In other embodiments, some wrapper panels are connected by a vertically sliding fit, and others are connected by screws in a more conventional manner. It should be appreciated by those skilled in the art, that alternatively, the L-shaped edge could be on corner panel 36 and the edges of side panel 30 could be similar to edge 88. It should also be appreciated, that wrapper 26 could have more or less than the eight panels shown in the drawing figures. For example, it would be well within the scope of the invention to provide a wrapper with just four side panels that interconnect directly with each other without intervening corner panels. Therefore, the scope of the invention is to be determined by reference to the claims, which follow.

We claim:

1. An outdoor unit for an air conditioner comprising:

a base, said base being fabricated from an engineered material;

a wrapper, said wrapper being disposed above said base;

a top, said top being disposed on said wrapper, said base, said wrapper and said top cooperating to define a cabinet having an interior and an exterior;

a heat exchanger, said heat exchanger being disposed in the exterior of said cabinet;

a compressor, said compressor being disposed interior of said cabinet; and a radio frequency identification device, said radio frequency identification device being disposed in said outdoor unit.

2. The outdoor unit according to claim 1 wherein said radio frequency identification device is embedded in said base, is self-powered and contains information relating to said outdoor section.

3. The outdoor unit according to claim 2 further comprising a query device, said query device triggering said radio frequency identification device to transmit information contained in said radio frequency identification device.

4. The outdoor unit according to claim 2 wherein the information contained in the radio frequency identification device is specific to the particular outdoor unit of which the base pan in which said radio frequency identification device is embedded is a component.

5. The outdoor unit according to claim 2 wherein said radio frequency identification device contains information relating to the manufacture and assembly of said outdoor unit.

6. The outdoor unit according to claim 2 wherein said radio frequency identification device contains information that assists in the servicing of said outdoor unit.

7. The outdoor unit according to claim 3 wherein said query device is disposed in a location in the manufacturing facility in which said outdoor unit is assembled, said location enabling said query device to trigger said radio frequency identification device as said outdoor unit proceeds through its assembly process.

8. The outdoor unit according to claim 3 wherein said query device is located in a position close enough to the location where said outdoor unit is installed in its end use location to trigger the transmission of information by said radio frequency identification device.

* * * * *